United States Patent [19]

Brookes

[11] Patent Number: 4,603,644

[45] Date of Patent: Aug. 5, 1986

[54] INCINERATOR AND CREMATOR

[76] Inventor: David R. Brookes, 111A Lakeshore Rd. E., Mississauga, Ontario L5G 1E2, Canada

[21] Appl. No.: 617,026

[22] Filed: Jun. 4, 1984

[30] Foreign Application Priority Data

May 18, 1984 [CA] Canada ..... 454735

[51] Int. Cl.[4] ..... F23G 1/00

[52] U.S. Cl. ..... 110/194; 110/165 R; 110/211

[58] Field of Search ..... 110/194, 235, 210, 211, 110/165 R

[56] References Cited

U.S. PATENT DOCUMENTS 1,742,868 1/1930 Mann ..... 110/194

4,321,878 3/1982 Segrest ..... 110/194

*Primary Examiner*—Edward G. Favors

*Attorney, Agent, or Firm*—Donald E. Hewson

[57] ABSTRACT

The cremator disclosed is of the kind in which reduction burning takes place in a coffin chamber, followed by oxidation burning in an afterburner chamber. It is also of the kind in which partly cremated embers can be moved to an ember-reducing location to make room for another coffin to be admitted to the coffin chamber. The disclosure shows the ash removal port in the side of the cremator, which allows the afterburner chamber to occupy space behind and underneath the coffin chamber; an arrangement which makes for a very compact, fuel efficient, easy-to-construct unit. The hearth includes an ash-trough for ember reduction. The hearth can be thin because it is supported on the central wall that divides the ducts of the afterburner chamber, which makes for good heat transfer, and quick warm-up.

12 Claims, 4 Drawing Figures

INCINERATOR AND CREMATOR

This invention relates to incinerators in general, and to cremators in particular.

FIELD OF THE INVENTION

It is known to use the principle of afterburning to make sure that gases discharged from an incinerator contain a minimum of pollutants. The principle is that the material to be burnt, such as a coffin, is first heated in a receiving chamber to drive off volatile constituents, which are then transferred to, and burnt in, an afterburner chamber. It is the practice to supply only a little air into the receiving chamber, to make sure that the materials are essentially reduced, and that the readily combustible gases and airborne particles are not too swiftly oxidized and consumed. When the gases and particles reach the afterburner chamber, they are mixed with an excess of air; because the easily combustible particles are still present an environment is created where even the hardest-to-burn particles may be oxidised.

It is also known to increase the throughput of a cremator by arranging to have two coffins in the cremator at the same time. When the junior coffin is to be placed in the receiving or coffin chamber, the partially consumed embers of the senior coffin are transferred to another part of the cremator for final cremation.

PRIOR ART

U.S. Pat. No. 4,321,878, Segrest, issued 30th Mar. 1982 shows a cremator. It is an object of the present invention to provide an incinerator and cremator which is of very much simpler construction, yet which has an enhanced performance in almost every respect.

BRIEF DESCRIPTION OF THE INVENTION

In the invention, the access port by which the fully consumed ash may be removed from the incinerator is in the side of the incinerator, not in the back. The benefits that stem from this very simple arrangement are set out in the description that follows, but they include the fact that the afterburner chamber may now fully occupy the space between the back of the receiving chamber, and the rear wall of the incinerator. Hence the design and layout of the afterburner chamber does not need to be compromised by the means for gaining access to the ash.

The afterburner chamber can thus be designed for efficient combustion. It is easy, when the restraints mentioned above are removed, to provide a duct in the chamber which is simply straight and regular. Such a duct provides the minimum retardation to gases flowing through it. The gases can swirl and mix without restraint from the walls. As the duct turns a corner, it is very easy also to arrange that the cross section of the duct widens, and then narrows again. Hence, a low velocity area is formed at the corner; and at a corner, the turbulence and churning of the gases is also improved. It will be seen from the description that follows that the very simple construction gives rise to a duct with a corner which has just the right characteristics for adequately mixing the gases and which also promotes the formation of a ready made low-velocity area in which a fireball may form and remain in a reasonably stable configuration.

DETAILED DESCRIPTION OF PREFERRED EMBODIMENT

Figure 1:
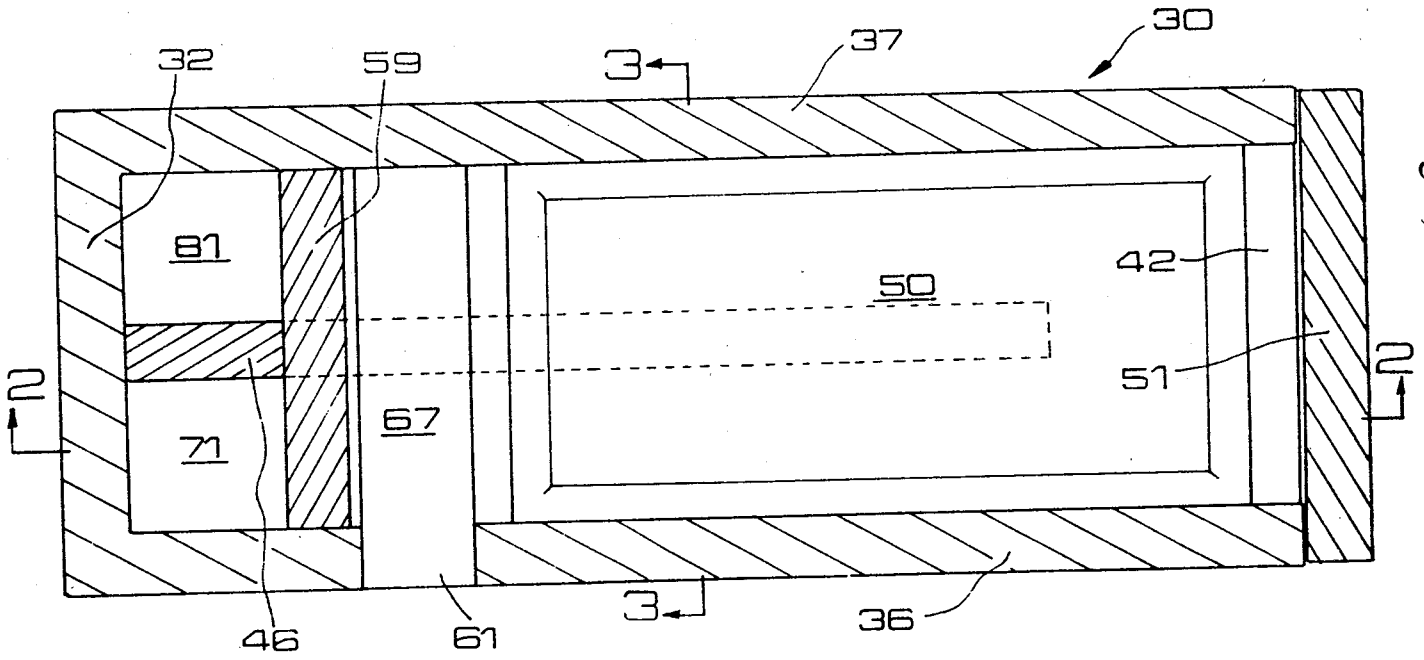
FIG. 1 is a sectioned plan view of a cremator.
Figure 2:
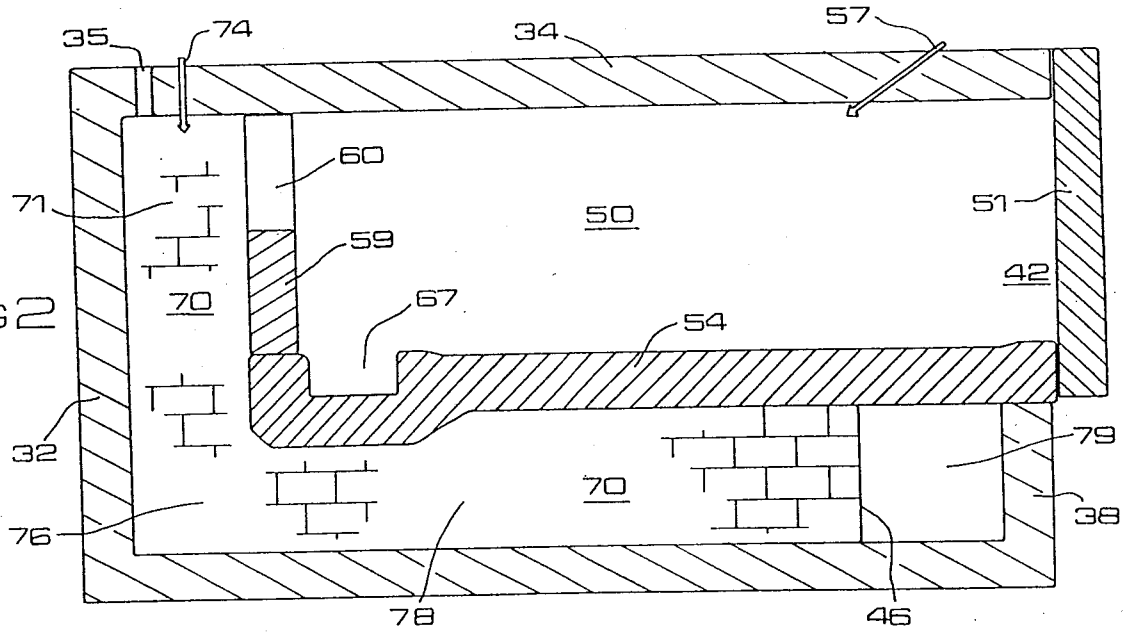
FIG. 2 is a sectioned side elevation of the cremator.

The cremator 30 shown in the drawings has a back wall 32, a roof 34, side walls 36,37 and a front wall 38. It includes a coffin chamber 50. The coffin chamber 50 has an openable loading door 51. Its floor comprises a hearth 54. An ignition burner is supplied with fuel and air, and fires a flame down onto a coffin placed in the chamber 50 in the direction shown by the arrow 57.

The coffin chamber 50 has a rear wall 59 that has an opening 60 in it. This opening 60 extends across approximately half the width of the rear wall 59, and partway down the rear wall. The opening 60 communicates the coffin chamber 50 with an afterburner chamber 70. Gases and airborne products of combustion flow from the coffin chamber 50 into the afterburner chamber 70 via the opening 60.

The afterburner chamber 70 comprises folded ducting extending from the opening 60 to a discharge stack 40. The first part of the afterburner chamber 70 is a rectangular down-duct 71 which extends vertically downwards. The afterburner unit 74 is positioned in the roof 34 on top of this duct 71 and is supplied with fuel and air to fire a flame vertically straight down the duct 71. Further air may be forced into the duct 71 through a hole 35.

The next part of the afterburner chamber 70 is a corner portion 76, in which the gases from the duct 71 are re-directed. The gases then flow along a first horizontal duct 78, around a transfer duct 79 at the front of the creamtor, back along a second horizontal duct 80, before entering a vertical stack-duct 81, and finally being discharged from the stack 40.

It will be seen that the two horizontal ducts 78,80 occupy the space underneath the hearth 54. The ducts 71, 78, 80, 81 do not communicate with each other, other than at their ends, so that the afterburner chamber 70, in effect, is one long passageway.

The brickwork required to make the afterburner chamber in the form described may be seen from the drawings. The hearth 54 is a pre-cast refractory structure. Its side edges are embedded in the side walls 36, 37 of the cremator 30. Its front edge forms the sill of the doorway 42. The rear wall 59 of the coffin chamber 50 rests on the back edge of the hearth 54; the hearth structure does not extend to the extreme back wall 32 of the cremator 30.

The hearth, takes support from a central dividing wall 46, which runs almost the length of the cremator except right at the front where the dividing wall 46 stops short of the front wall 38. The resulting gap comprises the transfer duct 79.

The simplicity of the construction of the cremator can be seen from the drawings. The central dividing wall 46 is simply a straight flat wall with no bends or archways in it. So is the rear wall 59 of the coffin chamber 50. Building the cremator 30 is easy, in that the central 46 front 38, and side 36,37 walls are first built up to the level at which the hearth 54 is to rest. The hearth 54 is laid on the supporting walls. The brickwork above the hearth is simply finished off without any need for supporting bridges or arches or over hangs.

There is, though, the need to provide an opening or port 61 for ash removal. The hearth includes an ash trough 67 at its rearmost end, the sides of the trough 67 being formed in the hearth casting. The trough 67 extends across the full width of the hearth.

The whole process of cremation of a typical coffin and its contents takes several hours, from placing the coffin in the chamber 50 until the calcified ashes are sufficiently broken down that they can be reduced to a fine powder. As mentioned earlier, the cremation process is done in two stages, so that the cremation of a senior coffin can be finished off while a junior coffin is present in the coffin chamber 50. Thus the throughput of the cremation unit can be increased. It is, of course, essential that the ashes of one coffin do not become mixed with the ashes of another, so that due reverence can be accorded to each.

In the unit shown in the drawings, the second stage of cremation takes place in the ash trough 67. The ash trough 67 is located, in the cremator of the invention, at the very hottest place, in that it is in the coffin chamber, and is surrounded not by outside walls but by the afterburner chamber 70, and by the coffin chamber 50. Only over the small area at its very edges is the ash trough 67 close to the relatively cooler outer walls, i.e., the side walls 36, 37, of the cremator 30.

When a new coffin is to be loaded into the cremator, the senior coffin already in the coffin chamber 50 has by now been reduced to embers, even though those embers may be some hours yet from being completely reduced. The ashes from a still earlier coffin, now residing in the ash trough 67, are first raked out of the ash trough from the port 61, and set aside to cool. The the embers in the coffin chamber 50 are pushed into the ash trough 67. It will be noted that only a simple front-to-back sweeping action is needed to achieve this, since the ash trough extends the full width of the hearth. Then the new coffin is loaded through the doorway 42 into the vacant coffin chamber. The ash-trough thus comprises the ember-reduction location.

The fact that the ash removal port 61 is in the side 36 of the unit is important, for this reason. It is important that the port 61 itself be small, so as not to pose too much of a sealing problem, and so as not to impose the need for complicated arrangements to support the wall above it. On the other hand, the port 61 must give full access to the trough 67 so that none of the ash is left behind. In the arrangement shown, the trough 67 is long, in that it extends across the full width of the cremator, so that a maximum area of the embers is exposed to the heat; yet even though the trough has this large exposure area, it only needs a small access port 61. If the cremator were arranged with the ash removal port in the back wall 32, say, it would be very difficult to combine a large ember-exposure area with full access through a small port to that large area. Besides, if the ash removal port were in the back wall, the ducts of the afterburner chamber would have to clear the port, and the construction would then have to be much more complicated.

Figure 3:
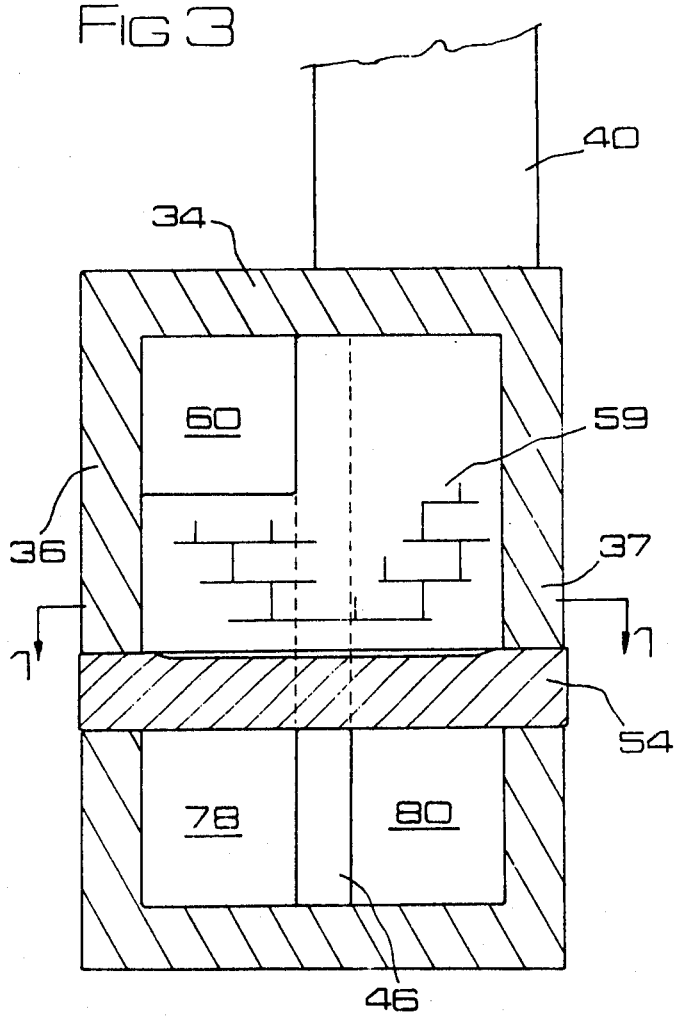
FIG. 3 is a sectioned front end elevation of the cremator.
Figure 4:
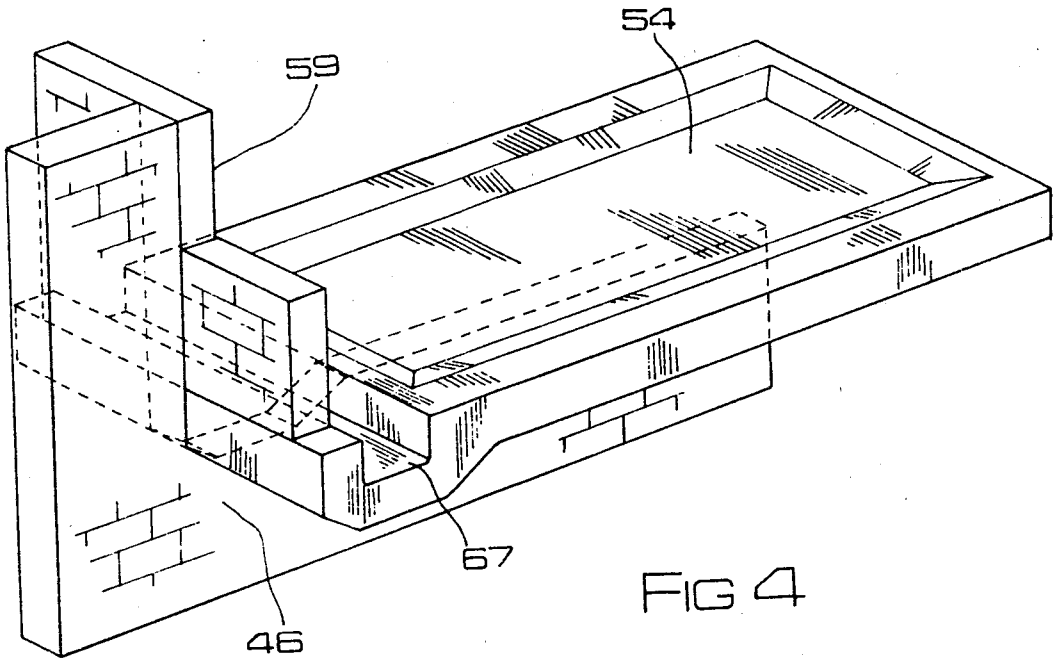
FIG. 4 is a view of some internal components of the cremator.

Putting the ash removal port 61 in the side wall 36 means that the port can be small, yet give full access to the trough; the trough itself can have a large ember-exposure area; and the ducts can occupy, without restriction, the space behind the coffin chamber. It can be seen from FIG. 3 that the cremator 30 is compact. Its width is determined purely by the width of the coffin chamber 50, not by any need to accommodate ducts. Even the stack 40 and the afterburner unit 74 need not extend beyond the sides.

The first and second horizontal ducts 78 and 80, respectively, of the afterburner chamber 70 occupy the space under the hearth 54. If these ducts were either too small or too large in cross-section, the airborne contents of the ducts might not be thoroughly mixed, and might consequently not be fully burnt bearing in mind the size of discharge stack, and the throughflow of combustion air, that can be conveniently and economically provided. A duct size of around 45 or 50 cm square turns out to have just the right characteristics to ensure excellent combustion and two such ducts 78, 80 can be fitted under the hearth 54 side-by-side, and similarly 71, 81 behind the hearth 54 side-by-side, in the compact manner illustrated.

The size of the duct is, as just mentioned, important in determining the best performance of the afterburner and its associated chamber. In the cremator described, gases and airborne particles are drawn through the opening 60 into the vertical down duct 71. When conditions are stabilised, the gases are churned and mixed in the down-duct 71, as they approach the corner portion 76. As the gases go through the corner portion 76, they undergo an expansion and a contraction due to the changing cross-sectional area of the duct as it turns the corner. They also undergo a further very vigorous mixing due to the change in direction.

The areas of the ducts 71 and 78 are both smaller than the area of the diagonal across the corner 76. Thus the gases rush down and along these ducts, but it may be regarded that the gases pause at the corner 76. Consequently, most of the burning or oxidation of the combustible volatiles takes place right in the corner itself. Even though the concentration of combustibles in the gases may vary, the fireball will not tend to move backwards or forwards into the ducts 71, 78 because of this velocity distribution. For best results in keeping the fireball stable, the cross sectional area of the duct 78 should be between 1.26 and 1.42 times the area of the diagonal plane across the corner 76.

Once combustion is under way, little fuel need be supplied through either of the burners 57 or 74, but it is important to make sure of an abundance of air in the afterburner chamber all the time to make sure that all that can be burnt is burnt.

Thus, the changes in velocity lead to the formation of a fireball in the corner portion 76, and the thorough mixing at that point ensures that all combustible particles are thoroughly burned.

Because the ducting is substantially square it has almost a minimum surface of exposed wall for its cross-section, so the gases tend not to be retarded by contact with the walls as they would be if the duct were tortuous or if it were of, say, a long narrow sectional shape. Thus, the very simple construction of the ducts, far from compromising the performance of the afterburner, actually enhances it.

The ducts containing the hot gases pass underneath the hearth. The hearth 54 is made no thicker than it need be for structural strength purposes, so that as much heat as possible can be transferred from the gases in the ducts below the hearth into the coffin chamber 50. Because of the good structural support of the hearth in the cremator described the hearth 54 can be relatively thin, to allow for a good heat transfer. Further-more, the thin hearth means that the heat-up time is relatively short. (A cremation unit has to start from cold each day; it is unusal to have cremations on a round-the-clock basis.)

A better fuel efficiency, a better ash reduction, and a cleaner effluent, arise from the arrangement of the afterburner chamber being disposed behind and underneath the receiving chamber. The unit is compact in that even the initial stack duct is within its confines. The unit is inexpensive both in materials and in ease of construction.

What is claimed is:

1. Incinerator, having front, side, and back walls, and a roof, comprising:

a receiving chamber for receiving material to be burnt lengthwise through a doorway in the front wall of the incincerator, the floor of the receiving chamber comprising a hearth;

an afterburner chamber, which has walls that define a relatively long, narrow passage;

means for releasing oxygen in copious quantities into one end of the passage;

stack means for discharging gases from the other end of the passage;

the arrangement being such that there is a vigorous blast of oxygen-rich gases in the passage;

an opening in the wall of the passage;

where the opening is so located and arranged:

(a) as to leave the passage still well-defined in the region of the opening;

(b) as to be out of the line of the direct blast of gases in the passage;

(c) that gases outside the passage are drawn into the passage through the opening by the blast of gases in the passage;

having an ember-reducing location to which partly consumed embers in the receiving chamber may be moved;

where the ember-reducing location is just below the said opening, to the extent that gases rising from the location are drawn directly towards and through the opening and into the passage;

where, in a cross-section taken on a vertical longitudinal plane of the incinerator, the ember-reducing location is widely spaced from the outside walls of the incinerator;

and having an ash removal port from which the fully consumed embers, in the form of ash, may be removed from the incinerator;

wherein the ash removal port is in one of the side walls of the incinerator; and wherein said ember-reducing location is an ash-trough, disposed at the back of the hearth, into which embers may be pushed from the doorway.

2. Incinerator of claim 1, wherein the ash-trough extends across the full width of the hearth.

3. Incinerator of claim 1, having a central dividing wall running lengthwise underneath the hearth for the whole length of the hearth apart from a small portion of the length of the hearth at the front of the hearth.

4. Incinerator of claim 3, wherein the weight of the hearth is partially supported on the central dividing wall.

5. Incinerator of claim 4, wherein the central dividing wall extends out from the back of the hearth to the back wall of the incinerator and upwards to the roof of the incinerator.

6. Incinerator of claim 5, wherein the receiving chamber has a rear wall which divides the receiving chamber from the afterburner chamber, apart from an opening in the rear wall to allow gases to pass from chamber to chamber, and wherein the rear wall rests on the hearth.

7. Incinerator of claim 6, wherein the opening is contiguous with the roof, a side wall, and the central dividing wall.

8. Incinerator of claim 7, wherein the afterburner chamber comprises a down-duct and a stack-duct disposed vertically side-by-side between the rear wall of the receiving chamber and the back wall of the incinerator; and, first and second ducts disposed side-by-side horizontally underneath substantially the whole length of the hearth, and arranged so that gases from the receiving chamber enter first the down duct, then the first duct, then the second duct, and then the stack duct.

9. Incinerator of claim 8, wherein the dimensions of the down duct and the first duct are such that the cross sectional area of the first duct is between 1.26 and 1.42 times the area of the diagonal across the corner between those two ducts.

10. Incinerator of claim 9, wherein the four ducts are each approximately 50 cm square, and straight.

11. Incinerator of claim 1, wherein the hearth is a preformed refractory casting.

12. Incinerator of claim 1 where the incinerator is a cremator, and the receiving chamber is a coffin chamber.

* * * * *